United States Patent [19]

Miehle

[11] Patent Number: 5,065,737

[45] Date of Patent: Nov. 19, 1991

[54] APPARATUS AND METHOD FOR CLEANING A GAS RANGE BURNER

[76] Inventor: Ernest C. Miehle, 1125 Deborah Dr., Costa Mesa, Calif. 92626

[21] Appl. No.: 188,060

[22] Filed: Apr. 26, 1988

Related U.S. Application Data

[63] Continuation of Ser. No. 19,743, Feb. 27, 1987, abandoned.

[51] Int. Cl.[5] ..... F02B 53/04

[52] U.S. Cl. ..... 126/214 R; 126/39 R

[58] Field of Search ..... 126/19 R, 21 R, 21 A, 126/39 R, 39 C, 39 E, 214 R, 273 R, 273 A; 431/3, 32, 121

[56] References Cited

U.S. PATENT DOCUMENTS

| | | | |
|---|---|---|---|
| 1,290,074 | 1/1919 | Bynum | 431/121 |
| 2,970,772 | 2/1961 | Boosinger et al. | 239/105 |
| 3,364,968 | 1/1968 | Mutchler | 431/238 |
| 3,984,310 | 10/1976 | Calderon | 201/2 |
| 4,472,133 | 9/1984 | Petersen et al. | 431/3 |
| 4,533,316 | 8/1985 | Takino et al. | 431/32 |
| 4,593,676 | 6/1986 | Wackerman | 126/39 R |
| 4,598,691 | 7/1986 | Herrelke et al. | 126/39 C |

OTHER PUBLICATIONS

Use and Care Gas Cooking Appliances Manual, Hardwick, Stove Co., Cleveland, Tenn., 5/1986.

Whirlpool Use and Care Guide, Gas Range Self-Cleaning Models SF375BEP, SF365BEP, 1984.

Thermador, Installation Instruction-Gas Cooktop, Model GTH30, 10/83.

Modern Maid, Model No. PHO-103 Gas Self Cleaning Wall Oven, Users manual 2/87.

*Primary Examiner*—Noah P. Kamen

*Attorney, Agent, or Firm*—Knobbe, Martens, Olson & Bear

[57] ABSTRACT

A method and apparatus for cleaning the burners of a gas cooking range in which food oils and particulates are removed from the burners via slow incineration caused by the provision of flame directly adjacent the burners which directly heats the burners.

27 Claims, 1 Drawing Sheet

Fig. 1
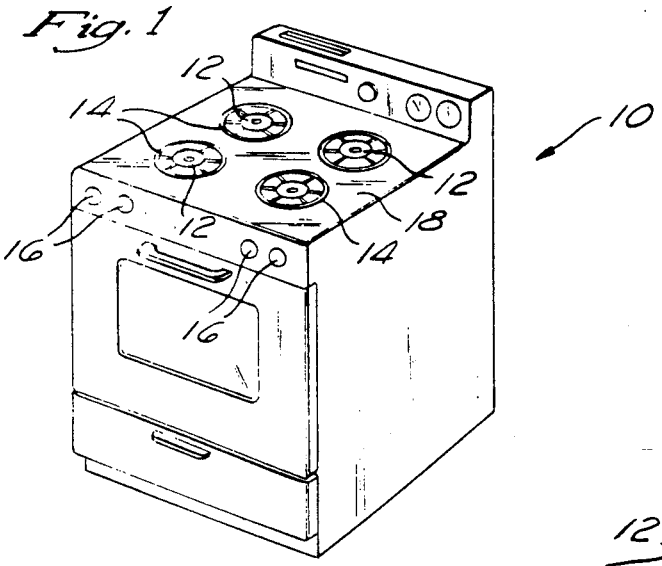
Fig. 2
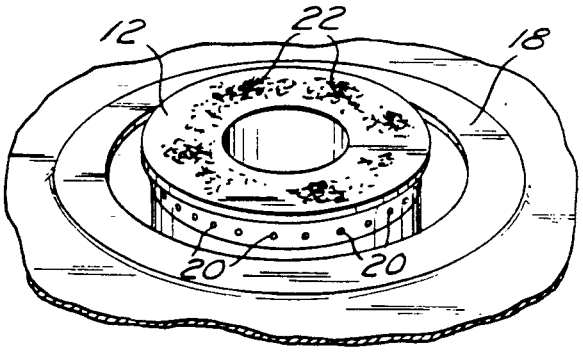
Fig. 3
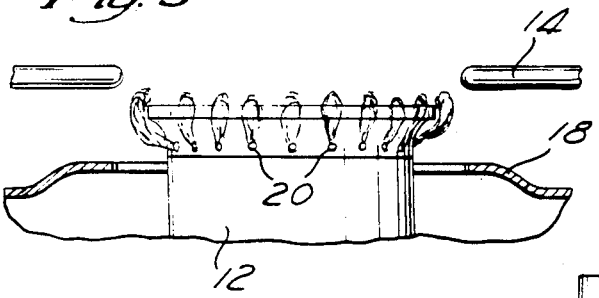
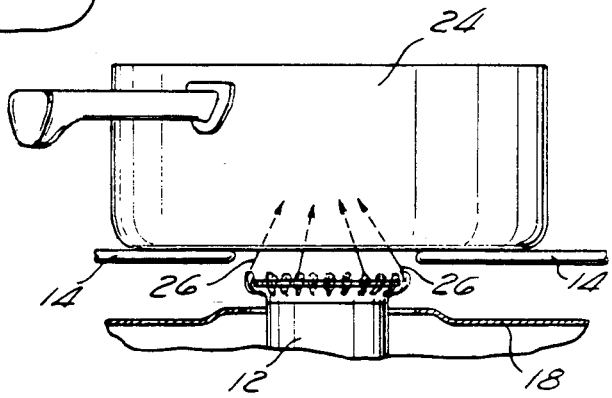
Fig. 4
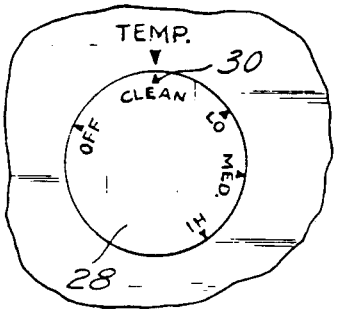
Fig. 5

APPARATUS AND METHOD FOR CLEANING A GAS RANGE BURNER

This is a continuation of U.S. Ser. No. 019,743, filed Feb. 27, 1987 now abandoned.

BACKGROUND OF THE INVENTION

This invention relates to an apparatus and method for cleaning a burner of a gas range, and more particularly to an apparatus and method for cleaning a gas range burner in which food oils and particulates on the burner are removed via slow incineration.

When food is heated over a burner on a gas range, food oils and particulates often splatter onto the burner being used and the other exposed burners that are not in use. Subsequent use of the burners causes the food oils and particulates to be carbonized on the burners, thus resulting in burner discoloration. As the gas range continues to be used, additional food oils and particulates accumulate on the burners and are carbonized during the subsequent use of the burners. As a result, unless the burners are regularly cleaned, a relatively thick carbonized coating builds up on the burners which is difficult if not impossible to remove, thus preventing the burners from being restored to their original clean appearance.

Manufacturers of gas ranges provide methods of cleaning the range burners; however, these methods are often detailed, cumbersome and messy procedures, which may include scrubbing the burners with detergents, abrasives, and the like. As a result, regular cleaning of the burners is discouraged, and the carbonized coating due to food oils and particulates is allowed to build up until it permanently discolors the burners, thus preventing restoration of the burners to their original appearance, regardless of the cleaning method used.

SUMMARY OF THE INVENTION

The present invention is directed towards a method of cleaning a gas range burner in which food oils and particulates are removed from the burner via slow incineration. In order to clean the burner, any substantial obstruction is removed from the vicinity of the burner that is to be cleaned, and then gas flow is provided to the burner to directly heat the burner. The flame is provided for approximately ten minutes to thirty minutes to slowly incinerate any food oils and particulates present on the burner.

In a further aspect of the invention, gas flow is provided to the burner at a rate of approximately 0.30 to 0.40 cubic feet per minute to provide a burner flame which slowly incinerates any food oils and particulates present on the burner. The flame is provided for approximately 15 minutes at which point the gas flow to the burner is terminated to extinguish the burner flame and to allow the burner to cool. Any ash residue remaining on the burner after the incineration of the food oils and particulates is then removed.

In a further aspect, the invention is directed towards a self-cleaning gas range having a plurality of burners through which natural gas is provided when the burners are in use. The range also includes a plurality of gas flow control knobs each of which has a marker which indicates a gas flow which produces a burner flame directly adjacent a respective one of the burners to directly heat the burner during cleaning so that food oils and particulates are removed via slow incineration.

It is an object of the invention to provide a simple and convenient method for cleaning a gas range burner.

It is another object of the invention to provide a method of cleaning a gas range burner which encourages frequent cleaning and thus prevents permanent discoloration of the burner due to carbonized food deposits.

These and other objects, features and advantages of this invention will be apparent in view of the following detailed description of a preferred embodiment, which is explained with reference to the figures, a brief description of which is provided below.

BRIEF DESCRIPTION OF THE DRAWINGS

FIG. 1 is a perspective view of a gas range having four burners;

FIG. 2 is a perspective view of one of the burners of FIG. 1 with its burner grate removed;

FIG. 3 is a side view of the burner of FIG. 2 with the burner grate in place, and showing the burner in operation;

FIG. 4 is a side view of a burner in operation with a burner grate supporting a pan overhead; and FIG. 5 is an illustration of a burner control knob which regulates the flow of gas provided to a burner.

DETAILED DESCRIPTION OF A PREFERRED EMBODIMENT

A gas range 10 having four burners 12 is shown in FIG. 1. Each of the burners has an associated grate 14. The flow of gas through each burner 12 is regulated by one of a plurality of flow control knobs 16. One of the burners 12 is illustrated in FIG. 2. This burner 12 rises slightly above the rangetop 18 and has a plurality of small orifices 20 through which natural gas flows when the burner 12 is being used. The burner 12 shown in FIG. 2 is soiled, having food oils and particulates 22 covering its surface. These food oils and particulates 22 are simply and easily removed in accordance with the invention by a process of slow incineration which is described in more detail below.

In order to clean the gas burner 12 in accordance with the invention, all substantial obstructions surrounding the soiled burner 12 are first removed. A substantial obstruction is defined as one which substantially affects the heat radiated by the burner 12. For example, in FIG. 4, a pot 24 is shown on top of the grate 14 over the burner 12. Heat radiated by the burner 12 is drawn away from the burner 12, as is indicated by the arrows 26. In effect, the pot 24 acts as a heat sink, drawing heat away from the burner 12. A burner grate may also be a substantial obstruction, depending upon its shape and construction. Preferably, all obstructions are removed from the area surrounding the burner 12 to prevent any interference with the natural heat convection of the burner 12. If substantial obstructions surrounding the burner 12 are not removed and heat or flame is drawn away from the burner 12, the removal of food oils and particulates by the slow incineration process described herein is adversely affected.

After any substantial obstruction surrounding the burner 12 is removed, the burner 12 is turned on via its knob 16 so that a relatively small flame is produced. The magnitude of the flame used to clean the burner 12 is important. The flame should be carefully adjusted so that it is directly adjacent to and heats the burner 12. Upon this proper adjustment, the flame impinges directly on the burner, the burner 12 is heated directly by the flame, and the portions of the burner 12 which are not in direct contact with the flame are heated by conduction of heat throughout the burner 12 to a temperature high enough to incinerate the food oils and particulates on the burner. This temperature is at least approximately 500° F. and may be higher. When the burner 12 is heated in this manner, food oils and particulates are gradually removed by slow incineration. FIG. 3 illustrates the burner 12 being cleaned by a flame having a properly adjusted height in accordance with the above description.

It has been determined that this slow incineration process is most effective when the magnitude of the flame is adjusted so that it is approximately 3/16 to ⅜ of an inch in height. This flame magnitude generally corresponds to a gas flow through the burner 12 of approximately 0.30 to 0.40 cubic feet per minute. The preferred gas flow also generally corresponds to approximately 1800 to 2400 BTUs. Of course, the relationship between the flame height and the gas flow in cubic feet per minute will depend on the number and size of the gas orifices 20 in the burner 12. For example, a burner having a greater number of gas orifices will generally require an increased gas flow to produce a flame of the same height as that produced by a burner with fewer orifices. In particular, such a "super" burner is commercially available in a standard size which, for the purposes of the invention, requires a gas flow larger by approximately one-third to achieve the same flame height to produce the desired slow incineration process. Thus, the preferred gas flow for a super burner is approximately 0.40 to 0.55 cubic feet per minute, which generally corresponds to approximately 2400 to 3200 BTUs.

After the flame height is initially adjusted, the burner 12 is left on for approximately 10–30 minutes, which may depend in part upon the quantity of food oils and particulates which have accumulated on the burner 12. Preferably, however, the burner 12 is left on for approximately 15 minutes. After the burner 12 is turned off, all food oils and particulates will have been incinerated, which can be determined by visual inspection. The burner 12 may, in some cases, be covered with a fine ash residue which may be removed with a clean damp cloth or by some other simple method. If the burner is not cleaned with the first sequence, the procedure may be repeated.

The above-described preferred method in accordance with the invention may be facilitated by a gas range having specially designed flow control knobs to regulate the natural gas flow through the burners. One such knob 28 is shown in FIG. 5. The knob 28 has an indicator 30 of the desired gas flow to most effectively remove food oils and particulates from its associated burner by this slow incineration process. Preferably, a conventional detent or click stop is provided in order to allow the user to quickly and easily adjust the knob 28 to the most preferred gas flow for cleaning as indicated by the indicator 30.

Although the invention has been described in connection with burners incorporated in a stand-alone gas range, the invention could, of course, be practiced in connection with burners incorporated into drop-in cooking tops which are installed directly into preexisting kitchen counter tops.

Modifications and alternative embodiments of the invention will be apparent to those skilled in the art in view of the foregoing description. Accordingly, this description is to be construed as illustrative only, and is for the purposes of teaching those skilled in the art the best mode of carrying out the invention. The details of the structure may be varied substantially without departing from the spirit of the invention, and the exclusive use of all modifications which come within the scope of the appended claims is reserved.

What is claimed is:

1. A method of cleaning a gas range burner in which food oils and particulates are removed from the burner via slow incineration, said method comprising the steps of:

(a) removing any substantial obstruction from the vicinity of a gas range burner that is to be cleaned; and (b) providing an amount of gas flow to the burner sufficient to produce a flame directly adjacent the burner and to directly heat the burner to a temperature sufficient to slowly incinerate any food oils and particulates present on the burner, the flame being provided until substantially all the food oils and particulates on the burner have been incinerated.

2. A method as defined in claim 1, wherein the flame in said step (b) is approximately 3/16 to ⅜ of an inch in height.

3. A method as defined in claim 2, wherein the gas flow in step (b) is provided for approximately ten minutes to approximately thirty minutes.

4. A method as defined in claim 3, additionally comprising the steps of:

(c) terminating gas flow to the burner in order to extinguish the burner flame;

(d) allowing the burner to cool; and (e) removing from the burner any ash residue remaining after the flow incineration of food oils and particulates.

5. A method as defined in claim 3, wherein the flame in said step (b) is provided for approximately 15 minutes.

6. A method as defined in claim 5, wherein the gas flow in said step (b) is provided at a rate of approximately 0.30 to 0.40 cubic feet per minute.

7. A method as defined in claim 5, wherein the gas flow in said step (b) is provided at a rate of approximately 0.40 to 0.55 cubic feet per minute.

8. A method of cleaning a gas range burner in which food oils and particulates on the burner are eliminated via slow incineration, said method comprising the steps of:

(a) removing any substantial obstruction from the immediate vicinity of a gas stove burner to be cleaned; and (b) providing gas flow to the burner at a rate of approximately 0.30 to 0.40 cubic feet per minute to produce a burner flame which slowly incinerates any food oils and particulates present on the burner, the flame being provided for at least approximately ten minutes and less than approximately thirty minutes.

9. A method as defined in claim 8, additionally comprising the steps of:

(c) terminating gas flow to the burner to extinguish the burner flame;

(d) allowing the burner to cool; and (e) removing from the burner any ash residue remaining after the slow incineration of food oils and particulates.

10. A method as defined in claim 8, wherein the flame in said step (b) is provided for approximately 15 minutes.

11. A method of cleaning a gas range burner in which food oils and particulates on the burner are removed via slow incineration, said method comprising the steps of:

(a) removing any substantial obstruction from the immediate vicinity of a gas range burner that is to be cleaned;

(b) providing as flow to the burner at a rate of approximately 0.30 to 0.40 cubic feet per minute to provide a burner flame which slowly incinerates any food oils and particulates present on the burner, the flame being provided for at least approximately 15 minutes;

(c) terminating gas flow to the burner to extinguish the burner flame;

(d) allowing the burner to cool; and (e) removing from the burner any ash residue remaining after the flow incineration of food oils and particulates.

12. A method of cleaning a gas range burner in which food oils and particulates on the burner are removed via slow incineration, said method comprising the steps of:

(a) removing any substantial obstruction from the immediate vicinity of a gas range burner that is to be cleaned;

providing as flow to the burner at a rate of approximately 0.40 to 0.55 cubic feet per minute to provide a burner flame which slowly incinerates any food oils and particulates present on the burner, the flame being provided for at least approximately 15 minutes;

(c) terminating gas flow to the burner to extinguish the burner flame;

(d) allowing the burner to cool; and (e) removing from the burner any ash residue remaining after the flow incineration of food oils and particulates.

13. A self-cleaning gas range, comprising:

a plurality of burners through which natural gas is provided when the burners are in use; and a plurality of gas flow control knobs, each of the knobs having a marker indicating a high position which provides a gas flow rate to the respective burner providing the highest cooking flame; and a marker indicating a gas flow which produces a burner flame directly adjacent said respective one of the burners to directly heat the burner during cleaning of the burner so that food oils and particulates are removed via slow incineration, wherein said marker for producing the flame to clean said respective burner represents a lower position than said high marker.

14. A self-cleaning gas range as defined in claim 13, wherein the marker indicates a gas flow which produces a flame approximately 3/16 to ⅜ of an inch in height.

15. A self-cleaning gas range as defined in claim 14, wherein the indicated gas flow is approximately 0.30 to 0.40 cubic feet per minute.

16. A self-cleaning gas range as defined in claim 14, wherein the indicated gas flow is approximately 0.40 to 0.55 cubic feet per minute.

17. A self-cleaning gas range as defined in claim 14, wherein the indicated gas flow is approximately 1800 to 2400 BTUs.

18. A self-cleaning gas range as defined in claim 14, wherein the indicated gas flow is approximately 2400 to 3200 BTUs.

19. A self-cleaning gas range as defined in claim 14, additionally comprising a detent stop for each of the gas flow control knobs in order to provide the gas flow indicated by the marker.

20. A self-cleaning gas range, comprising:

a plurality of burners through which natural gas is provided when the burners are in use;

a plurality of gas flow control knobs;

a detent stop for each of the gas flow control knobs, each of the detent stops causing its respective gas flow control knob to provide a gas flow that produces a burner flame directly adjacent a respective one of the burners to directly heat the burner during cleaning of the burner so that food oils and particulates are removed via slow incineration.

21. A self-cleaning gas range as defined in claim 20 wherein the gas flow produces a flame approximately 3/16 to ⅜ of an inch in height.

22. A self-cleaning gas range as defined in claim 21 wherein the gas flow is approximately 0.30 to 0.40 cubic feet per minute.

23. A self-cleaning gas range as defined in claim 21 wherein the gas flow is approximately 0.40 to 0.55 cubic feet per minute.

24. A self-cleaning gas range as defined in claim 21 wherein the gas flow is approximately 1800 to 2400 BTUs.

25. A self-cleaning gas range as defined in claim 21 wherein the gas flow is approximately 2400 to 3200 BTUs.

26. The gas range of claim 13, wherein said knobs include a marker indicating an low position which provides a flow of gas to said respective burner providing the lowest cooking flame; wherein said marker indicating gas flow which produces burner flame directly adjacent the respective burner is disposed below said low marker.

27. The self-cleaning gas range of claim 20, wherein each said gas flow control knob includes a detent stop for an off position which causes no gas to flow to the respective burner; a detent stop causing the maximum gas flow rate used in cooking; and wherein said detent stop for producing flame to clean said burner is disposed between said off detent stop and said maximum cooking flow rate detent.

* * * * *

UNITED STATES PATENT AND TRADEMARK OFFICE
CERTIFICATE OF CORRECTION

PATENT NO. : 5,065,737

DATED : November 19, 1991

INVENTOR(S) : Ernest C. Miehle

It is certified that error appears in the above-identified patent and that said Letters Patent is hereby corrected as shown below:

Column 4, line 36, change "flow incineration" to --slow incineration--.

Column 5, line 10, change "as flow" to --gas flow--.

Column 5, line 28, before "providing" insert --(b)--

Column 5, line 28, change "as" to --gas--.

Column 5, line 38, change "flow incineration" to --slow incineration--.

Signed and Sealed this

Sixth Day of April, 1993

*Attest:*

STEPHEN G. KUNIN

*Attesting Officer*

*Acting Commissioner of Patents and Trademarks*